United States Patent [19]

Jamison et al.

[11] 4,344,278

[45] Aug. 17, 1982

[54] LUBRICATED WIRE ROPE

[75] Inventors: Warren E. Jamison, Evergreen; James J. McVeigh, Lakewood, both of Colo.

[73] Assignee: Projected Lubricants, Inc., Denver, Colo.

[21] Appl. No.: 155,156

[22] Filed: May 30, 1980

[51] Int. Cl.[3] ..... D07B 1/10; D07B 1/16

[52] U.S. Cl. ..... 57/221; 57/217; 57/223; 57/232

[58] Field of Search ..... 57/7, 217, 221, 223, 57/232, 241, 250, 258, 292, 295, 296; 585/10

[56] References Cited

U.S. PATENT DOCUMENTS

| | | | |
|---|---|---|---|
| 2,028,158 | 1/1936 | Hodson | 57/7 X |
| 2,485,019 | 10/1949 | Somerville | 57/221 |
| 3,541,011 | 11/1970 | Davis et al. | 585/10 X |
| 3,824,777 | 7/1974 | Riggs | 57/217 X |
| 3,889,455 | 6/1975 | Portinari et al. | 57/7 |
| 3,979,896 | 9/1976 | Klett et al. | 57/217 |

*Primary Examiner*—Donald Watkins

*Attorney, Agent, or Firm*—O'Rourke & Harris

[57] ABSTRACT

A wire rope formed of a plurality of strands of wire rope elements wound around a core, and incorporating a lubricant which comprises a microporous polymeric lubricating medium.

6 Claims, 2 Drawing Figures

LUBRICATED WIRE ROPE

BACKGROUND OF THE INVENTION

1. Field of the Invention

The present invention relates to wire rope and, more particularly, to wire rope embodying a lubricant, and methods for producing the same.

2. Description of the Prior Art

Wire rope incorporating lubrication, principally heavy viscous lubricants such as petrolatum, is known in the art, and lubricated wire rope has further been impregnated with and surrounded by a jacket of a thermoplastic material in order to protect the wire strands and encapsulate the lubricant. The lubricant is generally extruded into the interstices of the wire strands, while the plastic surrounds either the strands individually or is extruded into the interstices of the wire rope.

Wire rope is formed by twisting together multiple wire strands around a central core. The strands are in turn formed by twisting together wires, also around a core material which may be wire, fiber or the like. The core strand likewise may be fiber, twisted wire or a combination thereof. In the formation of the strands, a heavy viscous lubricant may be incorporated within the interstices formed by the twisted wires and strands. Various configurations of wires and strands have been developed, depending upon the properties and characteristics desired in the wire rope. In the manufacture of wire rope, the strands are twisted together to form the rope by means of what is commonly termed a closing die. The heavy viscous lubricant is conventionally incorporated into the wire rope and strands by an injection mechanism adjacent the closing die. Where the rope or portions thereof are to be encapsulated in plastic, appropriate extrusion dies are utilized.

The construction of wire ropes and the incorporation therein of heavy viscous lubricants and surrounding thermoplastic materials and sheaths are disclosed in U.S. Pat. No. 3,195,299, issued July 20, 1965, to A. Dietz, for WIRE ROPE; U.S. Pat. No. 3,318,082, issued May 9, 1967, to P. P. Riggs, for PLASTICS IMPREGNATED ROPE; U.S. Pat. No. 3,824,777, issued July 23, 1974, to P. P. Riggs, for LUBRICATED PLASTIC IMPREGNATED WIRE ROPE; U.S. Pat. No. 3,874,158, issued Apr. 1, 1975, to F. Chiappetta et al., for WIRE ROPE WITH PLASTIC IMPREGNATED LUBRICATED CORE; and U.S. Pat. No. 4,120,145, issued Oct. 17, 1978, to F. Chiappetta et al., for LUBRICATED PLASTIC IMPREGNATED WIRE ROPE. Where necessary for a more detailed understanding of the present invention, the disclosures of the foregoing patents are incorporated herein by reference.

Oil bearing polymeric lubricating compositions have been disclosed which contain a hydrocarbon oil impregnated or encapsulated in the interstices of a high molecular weight polymer, such as polyethylene, to provide a gel like lubricating composition. Such materials are sometimes referred to as a microporous polymer lubricant or as a polymeric lubricating medium. See, for example, U.S. Pat. No. 3,541,011, issued Nov. 17, 1970, to W. J. Davis et al., for LUBRICATING COMPOSITION; and U.S. Pat. No. 3,547,819, issued Dec. 15, 1970 to W. J. Davis et al., for LUBRICATING COMPOSITION. These and similar lubricant materials may be formed by mixing polymeric materials, such as polyethylene, polypropylene, polyurethane, polyesters and polyamides with an appropriate lubricating oil, such as hydrocarbon or petroleum oils, silicone oils or other liquid lubricating materials. In use, the polymeric lubricating medium wicks lubricating oil to surrounding adjacent surfaces or areas. An increase in pressure increases the amount of oil wicked or weeped from the composition, and the composition reabsorbs oil when the pressure is released. Polymeric lubricating compositions other than those described in the patents to Davis et al. may be utilized to advantage.

OBJECTS AND SUMMARY OF THE INVENTION

The principal object of the present invention is to provide an improved lubricated wire rope.

Another object of the present invention is to provide an improved wire rope having a lubricating composition embodied therein which retains the lubricant and wicks the lubricant to the wire rope components when required.

A further object of the present invention is to provide an improved lubricated wire rope of the foregoing character, including an improved lubricant.

Still a further object of the present invention is to provide improved methods for incorporating a polymeric lubricating medium into the wire rope structure.

Another object of the present invention is to provide a wire rope including improved, long lasting internal lubrication.

Other objects and advantages of the present invention will become apparent as the following description proceeds, taken in conjunction with the accompanying drawings.

In accordance with the foregoing objects, the present invention comprises a wire rope incorporating as a long lasting lubricant a polymeric lubricating medium. The polymeric lubricating medium may be incorporated into the wire rope as part of the rope core. The medium may also be incorporated into the wire rope as a part of the strands utilized to make up the wire rope, as well as by incorporating the polymeric lubricating medium into the wire rope both as a part of the winding and as a part of the stranding as well as the closing operations. The polymeric lubricating medium may be extruded as a part of the wire rope and filling the voids therein, substantially to the nominal external diameter of the wire rope. Alternatively, the strands utilized to form the rope may be impregnated with the polymeric lubricating composition and then subsequently wound and closed into the wire rope configuration.

DESCRIPTION OF THE PREFERRED EMBODIMENT

Figure 1:
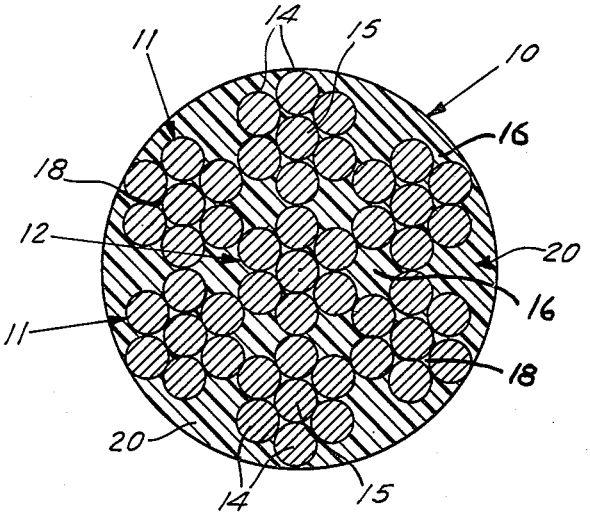
FIG. 1 is an enlarged cross-section through a multistranded wire rope, with an interstitial impacted polymeric medium, embodying the present invention.

The present invention is embodied in a wire rope incorporating a polymeric lubricating medium. Referring to FIG. 1, the wire rope 10 is formed by a plurality of strands 11 twisted together around a core 12. Each strand 11 is likewise formed by a plurality of wires 14 twisted together around a core 15. The wire rope may be made up of any number of strands 11, the typical number being six. Each strand may be made up of any number of wires and a core, depending upon the properties and strength desired. Because the wires and strands are generally circular in configuration, interstices 16 result in the strands and, likewise interstices 18 result in the wire rope as the strands are wound together. The various interstices, including the external or peripheral interstices, are, in accordance with the present invention, filled with a polymeric lubricating medium 20.

The polymeric lubricating medium is composed of a lubricating oil, a polymeric material which forms the structure of the lubricant medium, and various additives which enhance the action of the lubricating oil and control the properties of the medium. The components are compounded and processed into a thermoplastic form which can be further processed by conventional plastics processing equipment. The polymeric lubricating medium lubricates the rope by weeping oil under the rubbing and compressive forces in the strands and wires. In addition, the lubricating medium provides a cushion between the wires and strands to reduce stresses and redistribute loads. Accordingly, it is desirable that the polymeric lubricating medium be placed within the wire rope structure at the time of manufacture.

Figure 2:
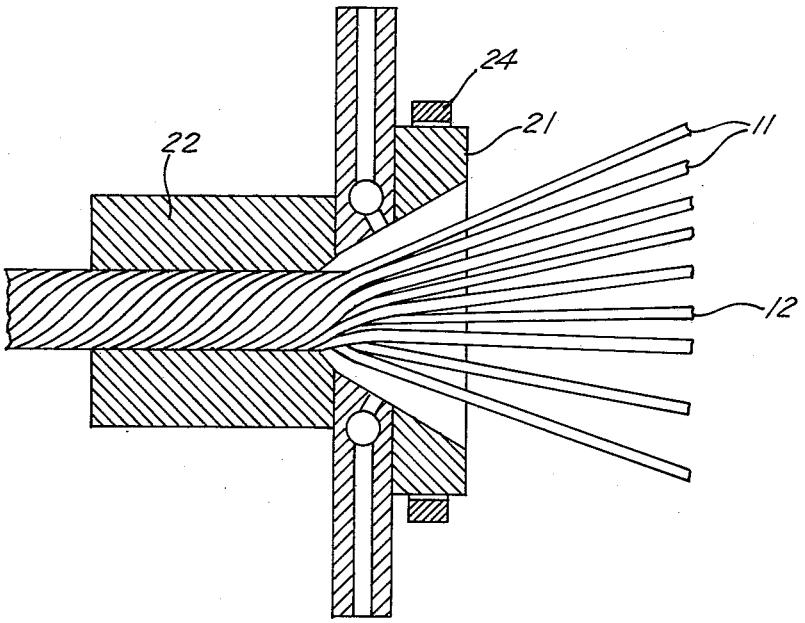
FIG. 2 is a diagrammatic illustration of a wire rope forming mechanism, including a closing die and polymeric lubricant applicator utilized in the method of the present invention.

One method of incorporating the polymeric medium into the rope is to heat soften and force feed the softened polymeric lubricating medium into the rope as it enters the closing die, as shown in FIG. 2. This may be accomplished by utilizing a lubricant die 21 just in front of the wire rope closing die 22. The lubricant die is fed with the polymeric lubricating medium by a screw extruder (not shown). The die is heated by an appropriate heating element 24. By heating the lubricant die 21 and closing die 22, and extruding the lubricating medium through the lubricant die, it is possible to fill all of the voids between the core and the strands and all of the valleys between the strands and the surface of the rope, resulting in a solid, cylindrical shape as shown in FIG. 1.

Another method of supplying the polymeric lubricating medium to the wire rope is to coat the individual strands before they are wound and closed into a rope. Such a technique would employ conventional equipment, for example, of the type used to coat electrical wire with plastic insulation. When the coated strands are passed through the closing die to form the rope, the polymeric lubricating medium will be deformed and plastically flow into the voids in the rope. The medium can be of such thickness as to provide any desired degree of filling of the voids or interstices in the wire rope. To this end, it may be necessary or desirable to heat the polymeric lubricating medium to soften it to aid in filling the voids. Heat may be applied by induction heating of the strands, or the closing die may be heated, or both. Further, the polymeric lubricating medium can be heated without heating the strands by application of ultrasonic energy to or preceeding the closing die, or by utilizing special fixtures for transmitting heat energy to the lubricating medium.

In some instances it may not be desirable, for some applications, to fill the entire wire or the exposed valleys between the strands on the surface of the rope. The polymeric lubricating medium can be applied various ways to provide continuous lubrication to the core and the strands. One method is to coat only the core of the rope prior to the closing. This can be accomplished in the same manner as coating of the strands described above. Coating can be done at a time and location remote from the closing machine or at the closing machine. However, winding of the coated core onto a spool may deform the polymeric lubricating medium coating prematurely. The coating can be of such thickness as to completely fill the internal voids between the strands and the core, or can be of any desired thickness according to the results desired.

It is also possible to introduce rod-like strands of the polymeric lubricating medium at the time of closing the strands to form the rope. These strands of polymeric lubricating medium can be wound directly together with the various wire strands, and to this end may be carried on a reel mounted in the machine adjacent the wire strand reels. The action of the closing die in the latter instance will deform the strands of polymeric lubricating medium and force them into and fill the triangular voids between the various wire rope strands. To increase the strength of the polymeric lubricating medium strands, a fiberous reinforcement may be incorporated in them. The reinforcing fibers may be glass, graphite, polymer or any other type of continuous or discontinuous fiber which is conventionally used in plastics reinforcement.

Where excess lubricant is incorporated into the wire rope, the plastic deformation of the polymeric material embodied therein would result in a squeezing of the lubricant from the polymeric lubricating medium which could then penetrate the strands and core and also migrate to the surface of the rope to lubricate the closing die. Sufficient lubrication is left within the polymeric lubricating medium to provide for lubrication over substantially the life of the rope.

In the foregoing manner, the present invention provides for internal lubrication of wire rope, including lubrication of the wire rope strands, through the squeezing of excess oil from the polymeric lubricating medium both during the closing operations, as well as subsequently during use of the rope. The present invention contemplates a variety of methods of incorporating a polymeric lubricating medium into the wire rope. The polymeric lubricating medium can be heated and softened, and then forced into the rope as strands enter the closing die. All of the voids or interstices up to and including the outside diameter of the wire rope may be filled with the polymeric lubricating medium. Because of the nature of the polymeric lubricating medium, it is not necessary to further encapsulate the strands, core, or wire rope in a thermoplastic material.

While certain illustrative embodiments of the present invention have been described above in considerable detail and will be set forth in the claims, there is no intention to limit the invention to the specific form disclosed. On the contrary, the intention is to cover all modifications, alternative constructions, equivalents and uses falling within the spirit and scope of the invention as expressed in the appended claims.

What we claim is:

1. A wire rope comprising a plurality of strands of wire rope elements wound around a core, and a lubricant, characterized in that said lubricant comprises a polymeric lubricating medium having a carrier and a lubricant incorporated therein such that said lubricant is expelled from said medium when compressive forces are applied to said medium by said strands of wire rope during use of said rope, and said lubricant is drawn back into said medium when said compressive forces are removed from said medium.

2. A wire rope comprising a plurality of strands of wire rope elements wound around a core strand wherein the improvement comprises a polymeric lubrication medium incorporated in the interstices defined by said strands, with said polymeric lubrication medium having a lubricant incorporated therein such that said lubricant is expelled from said medium when compressive forces are applied to said medium by said strands of wire rope during use of said rope, and said lubricant is drawn back into said medium when said compressive forces are removed from said medium.

3. A self-lubricating wire rope comprising a plurality of strands of multi-wire wire rope elements wound around a core strand comprising a core element and a lubricant, characterized in that said lubricant comprises a polymeric lubricating medium having a carrier and a lubricant incorporated therein such that said lubricant is expelled from said medium when compressive forces are applied to said medium by said strands of wire rope during use of said rope, and said lubricant is drawn back into said medium when said compressive forces are removed from said medium.

4. A self-lubricating wire rope comprising a plurality of multi-wire strands of wire rope elements wound around a core strand, each of said multi-wire strands comprising a plurality of wires having a lubricant in the interstices thereof and having a coating of said lubricant thereon, characterized in that said lubricant comprises a microporous polymeric lubricant having a carrier and a lubricant incorporated therein such that said lubricant is expelled from said medium when compressive forces are applied to said medium by said strands of wire rope during use of said rope, and said lubricant is drawn back into said medium when said compressive forces are removed from said medium.

5. A self-lubricating wire rope comprising a lubricated core including a central strand and a plurality of outer strands wound therearound, a lubricant filling the spaces between said outer strands and extending outwardly only to the extent of the outer diametrical limits of the rope, and a plurality of multi-wire strands wound around said lubricated core, characterized in that said lubricant comprises a microporous polymeric lubricant having a carrier and a lubricant incorporated therein such that said lubricant is expelled from said medium when compressive forces are applied to said medium by said strands of wire rope during use of said rope, and said lubricant is drawn back into said medium when said compressive forces are removed from said medium.

6. A wire rope as defined in any of claims 1, 2, 3, 4 or 5 wherein said microporous polymeric lubricant comprises the admixture of polyethylene and a hydrocarbon lubricating oil.

* * * * *